United States Patent [19]

Aisaka et al.

[11] 4,036,034

[45] July 19, 1977

[54] ELECTRONIC METHOD AND APPARATUS FOR PATTERN FORMATION IN CIRCULAR KNITTING MACHINE

[75] Inventors: Noboru Aisaka; Tadashi Shindo, both of Yokohama; Tatsuya Kawakami, Tokyo, all of Japan

[73] Assignee: Agency of Industrial Science & Technology, Tokyo, Japan

[21] Appl. No.: 662,167

[22] Filed: Feb. 27, 1976

Related U.S. Application Data

[63] Continuation-in-part of Ser. No. 554,310, Feb. 28, 1975, abandoned, which is a continuation of Ser. No. 295,100, Oct. 5, 1972, abandoned, which is a continuation of Ser. No. 53,365, July 6, 1970, abandoned.

[30] Foreign Application Priority Data

July 7, 1969 Japan ..... 44-53918

[51] Int. Cl.[2] ..... D04B 9/00

[52] U.S. Cl. ..... 66/50 R; 66/154 A

[58] Field of Search ..... 235/151.22, 92 NG, 92 SH, 235/92 PD; 66/50 R, 75, 154 A; 340/172.5

[56] References Cited

U.S. PATENT DOCUMENTS

| | | | |
|---|---|---|---|
| 2,874,633 | 2/1959 | Goldberg et al. | 340/172.5 |
| 3,196,403 | 7/1975 | Ivins | 340/172.5 |
| 3,441,908 | 4/1969 | Mizzi | 340/172.5 |
| 3,446,037 | 5/1969 | Sutton | 66/25 |
| 3,670,527 | 6/1972 | Bourgeios | 66/50 R |
| 3,709,002 | 1/1973 | Brandt et al. | 60/50 X |
| 3,760,610 | 9/1973 | Hadam et al. | 66/75 X |
| 3,940,951 | 3/1976 | Christiansen | 66/50 R |

FOREIGN PATENT DOCUMENTS

| | | | |
|---|---|---|---|
| 1,474,081 | 2/1967 | France | 66/50 R |

*Primary Examiner*—Ronald Feldbaum

*Attorney, Agent, or Firm*—Ernest G. Montague; Karl F. Ross; Herbert Dubno

[57] ABSTRACT

Disclosed is a method and apparatus for knitting patterns with a circular knitting machine provided with an annular array of knitting needles and groups of needle actuators. Pattern signals in binary notation are read out of a memory device and written into first one and then the other of a pair of counter stages. While pattern signals for a given course of knitting are being read out from one counter stage and forwarded to the corresponding actuators, pattern signals for the next course of knitting are written into the other counter stage from the memory device. The pattern signals alternately read out from first one and then the other counter stage are forwarded to the corresponding actuators by means of selection circuits to thereby produce a knit fabric having a continuous colored pattern.

11 Claims, 12 Drawing Figures

RED

BLUE

WHITE

CIRCULAR KNITTING MACHINE
MACHINE-PULSE GENERATOR
MACHINE PULSE
MEMORY
SPROCKET PULSE
START
WRITING COUNTER
READING COUNTER
1
2a
2c
3a
3b
3c
3d
4
5a
5c
5e
6a
6c
6e
7
8
G1
G2
G11
G12
G13
G14
G15
G16
G17
G18
G21
G22
G23
G24
G25
FF1

18th-course signals

19th-course signals

20th-course signals

ELECTRONIC METHOD AND APPARATUS FOR PATTERN FORMATION IN CIRCULAR KNITTING MACHINE

REFERENCE TO RELATED APPLICATIONS

This is a continuation-in-part of our copending application Ser. No. 554,310 filed 28 Feb. 1975 as a continuation of our application Ser. No. 295,100, in turn, had been filed 5 Oct. 1972 as a continuation of our application Ser. No. 53,365 filed 6 July 1970, all now abandoned.

BACKGROUND OF THE INVENTION

Our present invention relates to an electronic method and apparatus for pattern formation in a circular knitting machine.

Pattern formation in a circular knitting machine provided with an annular array of knitting needles around the outer periphery thereof has conventionally been accomplished by rotating the knitting machine so as to cause the knitting needles to make stitches at the desired actuators for actuating yarn feeders. In the pattern drum method for mechanically performing pattern formation, for example, the selection of needles has heretofore been accomplished by disposing a pattern drum for each actuator, planting pins on the outer peripheral surface in such a way as to constitute a memorized set of pattern signals, and employing a jack for grouping the knitting needles by pattern size.

In controlling the pattern formation in a circular knitting machine, a memory device stores all the pattern signals for the whole pattern to be knitted, even when it is composed of a plurality of small patterns of the same shape and size, and forwards the signals to each of the corresponding actuators disposed around the outer periphery of the circular knitting machine in synchronism with their read-out from the memory device.

In case the circular knitting machine is provided with a plurality of actuators for actuating yarn-feeders therearound in order to accelerate the knitting operation, and a signal course of pattern knitting is completed in one rotation of the machine, pattern signals must be fed for as many courses of knitting as there are groups of actuators. Consequently, the knitting mechanism becomes highly complex in signal-reading means, memory device, etc. There is a severe limit on the size of pattern to be formed and on the ease with which pattern modification can be accomplished.

Unlike the conventional method which forms knit patterns by mechanical means, the present invention is directed to an electronic method of pattern formation wherein all signals are first processed by a command device and then used to control the operation of needle actuators mounted on the circular knitting machine.

OBJECTS OF THE INVENTION

An important object of the present invention is to provide a patterning method and apparatus readily applicable to conventional circular knitting machines.

Another object of this invention is to provide a method and apparatus for pattern formation wherein all the knitting needles are caused to knit the same course of the pattern at the same time.

Still another object of the present invention is to provide a method and apparatus facilitating the formation, of a rich variety of patterns by making it possible to form various patterns at desired positions on the knit fabric and to slant these patterns in operation to the left or right as desired.

SUMMARY OF THE INVENTION:

To accomplish the objects described above, the present invention provides a method of pattern formation in a circular knitting machine which comprises storing in a memory device at least two kinds of pattern signals given in binary notation from a desired pattern of at least three colors, reading out of the memory device the pattern signals, forwarding the pattern signals read out of the memory device to at least two pairs of counter stages so that while the pattern signals for one course are read out of one counter stage of each pair, the pattern signals of the next course are written in the other counter stages thereof, producing at least one other kind of pattern signal from the pattern signals read out of the pairs of counter stages by means of NOT circuits, and forwarding the pattern signals read out of the pairs of counter stages and the NOT circuits to the corresponding needle actuators disposed on the outer periphery of the circular knitting machine via selection circuits.

With the aid of ancillary equipment installed on the machine, we can readily produce a seamless tubular fabric having a continuous intricate multicolor pattern.

BRIEF DESCRIPTION OF THE DRAWING

The above and other objects and characteristic features of the present invention will be described in further detail hereinafter with reference to the accompanying drawing in which.

DETAILED DESCRIPTION OF THE INVENTION:

The invention will first be explained with reference to the operation of knitting the multicolored pattern shown in FIG. 1 with a circular knitting machine. Yarns of colors corresponding to the colors of the pattern (red, blue and white in the pattern shown) are respectively fed to the knitting needles arranged around the circular knitting machine via the related actuators. The knitting needles to which a yarn of a color to be knitted at the front side of fabric is fed perform pattern knitting (knitting action) whereas the other needles perform fabric knitting (welt action) and do not perform pattern knitting at the front side thereof.

Figure 2:
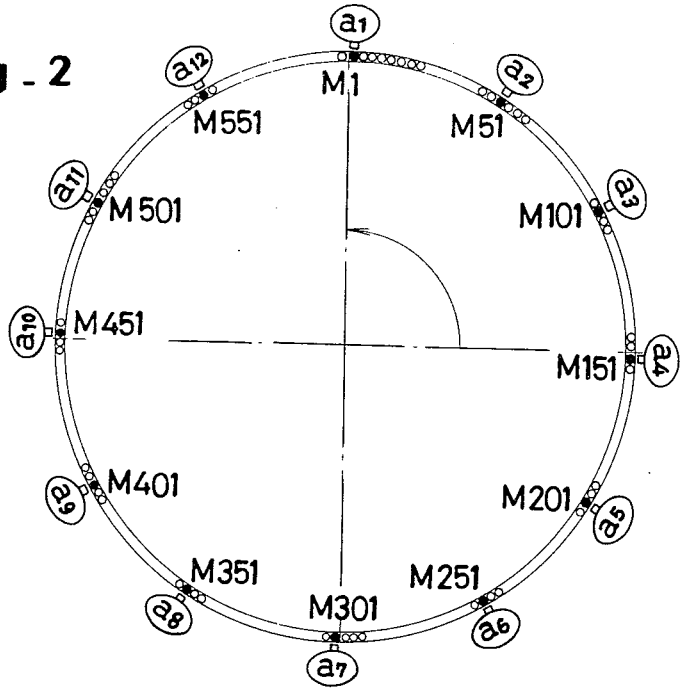
FIG. 2 is a diagrammatic view showing a circular knitting machine wherein the needle actuators are disposed at equal intervals on the outer peripheral surface thereof.

As shown in FIG. 2, in one embodiment of our invention there are provided four sets of actuators, each set comprising one actuator for each of the three color yarns to be fed to the knitting needles on the circular knitting machine. There are consequently a total of twelve actuators and these are disposed at equal intervals around the outer periphery of the machine.

Assume that the circular knitting machine provided with these actuators has a total of 600 knitting needles. As the knitting machine rotates, the yarns of each color are fed to the knitting needles by the related actuators. Thus, in making a one-quarter rotation, the knitting machine finishes one apparent course of knitting operation.

This will be more easily understood by first examining the knitting operation for the red yarn only. Red-yarn actuator $a_1$ starts knitting the pattern from the 1st knitting needle $M_1$ and a second red-yarn actuator $a_4$ starts from the 151st needle $M_{151}$ trailing the needle $M_1$ by 90°. Likewise, two other red-yarn actuators $a_7$ and $a_{10}$ start from the 301st needle $M_{301}$ and the 451st needle $M_{451}$, respectively. When the circular knitting machine has finished a one-quarter rotation, the actuators $a_1$, $a_4$, $a_7$ and $a_{10}$ face needles $M_{150}$, $M_{300}$, $M_{450}$ and $M_{600}$ respectively. That is, each actuator faces the needle immediately preceding the needle faced by the to trailing red-yarn actuator at the beginning of the knitting operation. The actuators for blue yarn $a_2$, $a_5$, $a_8$ and $a_{11}$ and the actuators for white yarn $a_3$, $a_6$, $a_9$ and $a_{12}$ simultaneously perform knitting operation interlacing these yarns with the yarns fed through the actuators for red yarn $a_1$, $a_4$, $a_7$ and $a_{10}$. The knitting performed by a one-quarter rotation of the knitting machine is referred to above as one "apparent" course because, strictly speaking, there is a one-pitch distance between the courses knitted by, for example, actuator $a_1$ and the next actuator $a_4$. This difference is not noticeable even on careful observation because the yarns are respectively twisted to the adjoining yarns of the same color on the front side of the fabric. By this method, the circular knitting machine can produce a seamless tubular fabric having a continuous pattern.

Figure 3:
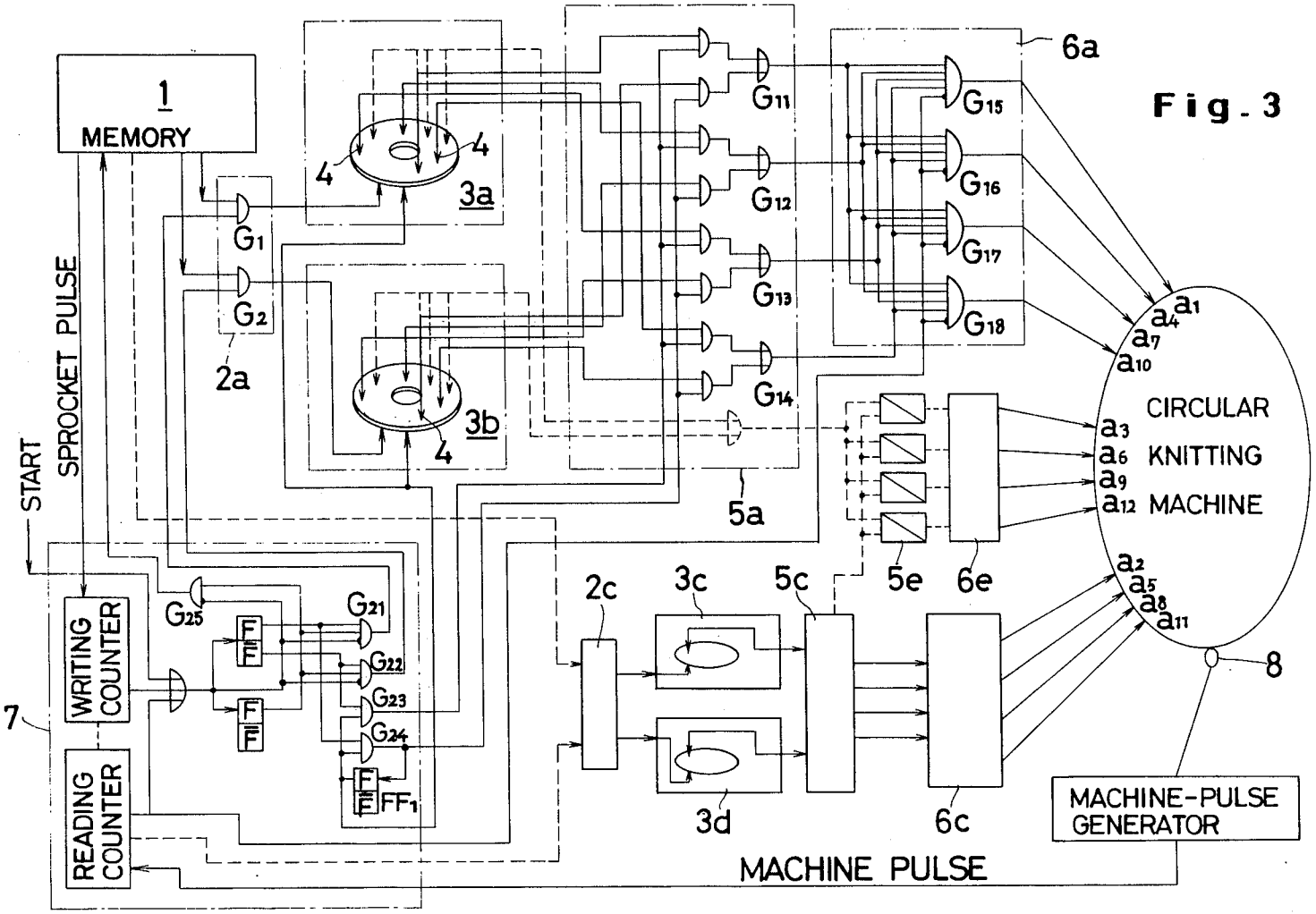
FIG. 3 is a system diagram showing a circular knitting machine with twelve yarn feeders for the formation of a three-color pattern in accordance with our invention.

An explanation of an embodiment in which the above-mentioned knitting method is electrically accomplished is now given with reference to FIG. 3.

Figure 1:
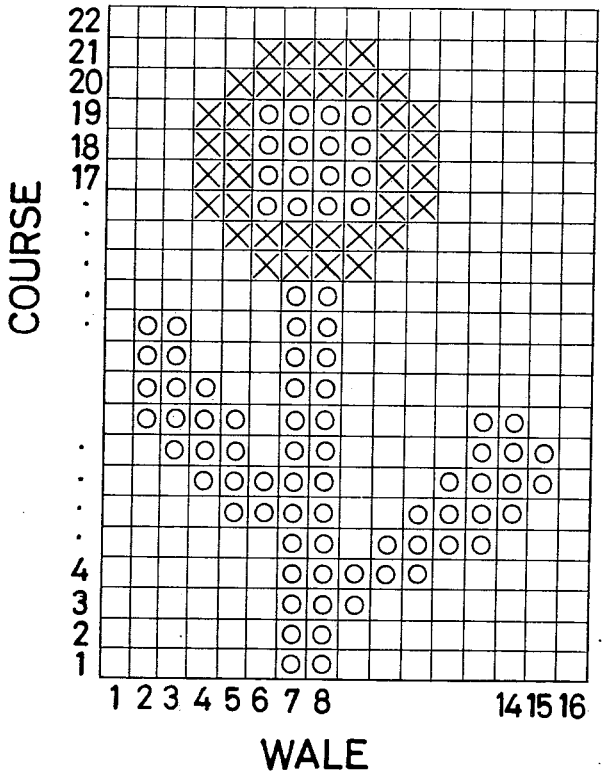
FIG. 1 shows the layout of an original three-color pattern to be knitted.

The pattern to be knitted is first put into mesh form as shown in FIG. 1 and the color information of the pattern is converted into binary digits which are memorized by a memory device employing paper tape, cards, magnetic tape or the like. Color information for only two of the three colors need be memorized.

The sample example pattern shown in FIG. 1 comprises 352 meshes corresponding to 22 courses × 16 wales. In this pattern the red-color information for the 19th course can be expressed in binary notation as $C_1^{19}$ [0001100001100000], where 1 stands for a signal which causes an actuator to perform pattern knitting and 0 stands for a signal which causes an actuator to perform fabric knitting. Red-yarn actuator $a_1$ receives the 1st binary signal for the 19th course when it faces needle $M_1$. As the first signal in the 19th course is 0, needle $M_1$ performs fabric knitting. It then receives the subsequent signals one by one in order as the knitting machine rotates. The 16th and last signal is received when actuator $a_1$ faces needle $M_{16}$. The series of signals is then repeated beginning from $M_{17}$. Knitting continues in this fashion until the knitting machine has made a one-quarter rotation and actuator $a_1$ faces needle $M_{150}$. In synchronism with actuator $a_1$ which begins the knitting operation from needle $M_1$ in accordance with the 19th course signals $C_1^{19}$, the other red-yarn actuators $a_4$, $a_7$ and $a_{10}$ knit the continuous pattern for the same course beginning from needle $M_{151}$, $M_{301}$ and $M_{451}$ respectively, also in accordance with the 19th-course signals $C_1^{19}$. However, it will be easily seen that the continuity of the knitted patterns cannot ordinarily be maintained if the signals for the 19th course are fed to the remaining actuators beginning from the first signal in the series of signals $C_1^{19}$. In the example under consideration the color information for each course is a series of sixteen signals which are repeated as many times as necessary to complete knitting operation. This means that if actuator $a_1$ receives the first signal in series $C_1^{19}$ when it faces needle $M_1$, it will receive the 6th signal in series $C_1^{19}$ when it faces needle $M_{150}$. Thus, in order to maintain the continuity of the pattern, the first signal to be fed to actuator $a_4$ when it begins the knitting operation from needle $M_{151}$ must be the seventh signal in series $C_1^{19}$. In general, the signal number $r_n$ of the signal to be fed to an actuator facing needle $M_n$ can be determined by the following equation:

$$r_n = N - W \cdot R$$

wherein: N = Number of the needle $M_n$

W = Number of wales in the pattern to be knitted

R = Number of full patterns between $M_1$ and $M_n$.

From this equation it can be easily found that the starting signals for actuators $a_7$ and $a_{10}$ facing needles $M_{301}$ and $M_{451}$ must be the 13 th wale signal and the third wale signal of the 19th course signals $C_1^{19}$.

The blue-yarn actuators and the white-yarn actuators are disposed at equal intervals between the red-yarn actuators and participate in the knitting operaton simultaneously with the red-yarn actuators. As can be seen in FIG. 1, the 19th course signals to be repeatedly fed to blue-yarn actuators $a_2$, $a_5$, $a_8$ and $a_{11}$ are $C_2^{19}$ [0000011110000000] and the 19th course signals to be repeatedly fed to white-yarn actuators $a_3$, $a_6$, $a_9$ and $a_{12}$ are $C_3^{19}$ [1110000000011111]. The 12 actuators are disposed around the circular knitting machine at equal intervals separated from each other by 50 needles. The following table shows the relationship among the actuators, needles and signal numbers of the signals first fed to the respective actuators, assuming that actuator $a_1$ begins actuating needle $M_1$ on reception of $C_1^{19}$ signal $r_1$.

| Red Yarn | | Blue Yarn | | White Yarn | |
|---|---|---|---|---|---|
| $a_1$ | $M_1$ $r_1$ | $a_2$ | $M_{51}$ $r_3$ | $a_3$ | $M_{101}$ $r_5$ |
| $a_4$ | $M_{151}$ $r_7$ | $a_5$ | $M_{201}$ $r_9$ | $a_6$ | $M_{251}$ $r_{11}$ |
| $a_7$ | $M_{301}$ $r_{13}$ | $a_8$ | $M_{351}$ $r_{15}$ | $a_9$ | $M_{401}$ $r_1$ |
| $a_{10}$ | $M_{451}$ $r_3$ | $a_{11}$ | $M_{501}$ $r_5$ | $a_{12}$ | $M_{551}$ $r_7$ |

If the knitting operation is initiated in accordance with the above table, the pattern of the knitted fabric will be continuous at all points except where the end of course 19 meets its beginning, that is between $M_{600}$ and $M_1$. Continuity can be maintained here only if the number of needles in the circular knitting machine is a multiple of the number of wales in the pattern.

FIG. 3 schematically shows one embodiment of the present invention encompassing a system for suitably feeding signals to the corresponding actuators according to the above table.

Color information for two colors optionally selected among the three colors of the pattern are read out from a memory device 1 by, for example, a tape reader and fed to a pair of gating circuits 2a and 2c, respectively.

As an example, the flow of information for driving the red-yarn actuators in the operation of knitting the 19 th course in the pattern shown in FIG. 1 is hereinafter traced through the system of FIG. 3. The two types of color information are treated in the same manner by parallel networks.

The signals of the red-yarn information for the 19th course $C_1^{19}$ are fed from memory device 1 to a counter stage 3a via an AND gate $G_1$ of circuit 2a. At the same time, the signals for the preceding course are being read out of a counter stage 3b. For easier understanding of this mode of operation, we have illustrated counter stages 3a–3d as mechanical devices. However, the counter stages of the present invention are, in practice, each composed of a circuit of large storage capacity and therefore can be easily adapted to various changes in the operating parameters such as number of different color yarns to be knitted, pattern width and so on.

Upon completion of course 18, signals $C_1^{19}$ memorized by counter stage 3a are read out by means of four fixed contacts 4 (shown in solid lines). Each contact 4 reads out red-yarn signals for one of the four red-yarn actuators beginning from the appropriate signal in the series as shown in the table above. Fixed contacts 4 can be adjusted according to the width (number of wales) of the original pattern.

Counter stage 3b is likewise provided with four fixed contacts 4 arranged in the same manner as the contacts in counter stage 3a. As shown in FIG. 3, similar sets of contacts 4 are also provided in counter stages 3c, 3d for another color selected from among the three colors. The contacts shown in dotted lines are for the white yarns and are also arranged in counter stages 3a–3 d in accordance with the table.

As the 19th-course signals for red yarn are read out of counter stage 3a, the 20th-course signals are simultaneously written in counter stage 3b, by way of an AND gate $G_2$ in circuit 2a.

When the circular knitting machine finishes one quarter rotation and actuator $a_1$ has successively actuated knitting needles $M_1$ to $M_{150}$ in accordance with the red-yarn signals for the 19th course, counter stages 3a and 3b are switched over by a gating circuit 5a , including AND gates $G_{11}$ – $G_{14}$, so that the 20th-course signals $C_1^{20}$ are read out of counter stage 3b and simultaneously counter stage 3a receives 21st-course signals from memory device 1 through gate $G_1$. The two counter stages 3a and 3b are switched over in this manner every quarter turn of the circular knitting machine.

At the time actuator $a_1$ starts the knitting of the 19th course from knitting needle $M_1$, the fixed contact 4 for actuator $a_1$ is at position $r_1$ of counter stage 3a. When actuator $a_1$ has finished knitting one quarter course and faces needle $M_{150}$, it can easily be found that its contact 4 is at position $r_6$ of counter stage 3a. Thus, when needle $M_{151}$ comes opposite actuator $a_1$, actuator $a_1$ must receive the seventh signal $r_7$ seventh wale) of the signals for the 20th course $C_1^{20}$ to start the 20th-course knitting. However, at the time of switchover, the contact 4 of the counter stage 3b corresponding to actuator $a_1$ starts to read out signal $r_1$ and it is necessary to compensate for the discrepancy. We therefore provide a selection circuit 6a, comprising of gates $G_{15}$ – $_{G18}$, designed to correct the disagreement between signal $r_1$ actually read out from counter stage 3b and signal $r_7$ which must be fed to actuator $a_1$. More particularly, at the start of the knitting of the 19th course, the course signals read out of counter stage 3a via gates $G_{11}$ – $_{G14}$ are fed to selection circuit 6a and the signals $r_1$, $r_7$, $r_{13}$ and $r_3$ of the 19th-course signals are fed to actuators $a_1$, $a_4$, $a_7$ and $a_{10}$, respectively. When the circular knitting machine finishes knitting the 19th course, counter stages 3a and 3b are switched over by gates $G_{11}$ – $G_{14}$ to feed the 20th course signals $C_1^{20}$ to selection circuit 6a, whereas the 20th course signals read out of counter stage 3b after the switchover to begin knitting of the 20th course of the pattern are shifted by a group of AND gates in cascade with OR gates $G_{15}$ – $G_{18}$ which are switched synchronously with the switchover between counter stages 3a and 3b so as to feed the signal $r_7$ of the 20th course signals $C_1^{20}$ from gate $G_{12}$ to actuator $a_1$ via gate $G_{15}$, the signal $r_{13}$ from gate $G_{13}$ to actuator $a_4$ via gate $G_{16}$, the signal $r_3$ from gate $G_{14}$ to actuator $a_7$ via gate $G_{17}$ and the signal $r_1$ from gate $G_{11}$ to actuator $a_{10}$ via gate $G_{18}$. The signals shifted by selection circuit 6a are properly fed to the actuators.

Furthermore, the signals for the blue yarn are also fed to actuators $a_2$, $a_5$, $a_8$ and $a_{11}$ via a circuit 6a for red yarns.

In FIG. 3 there is simply illustrated a control circuit 7 used for controlling the operation of the network described so far. Control circuit 7 receives a sprocket pulse forwarded from the tape reader of memory device 1 and feeds a synchronizing pulse to the tape reader via a gate $G_{25}$ to synchronously drive the writing counters and the tape reader. A reading counter within control circuit 7 receives machine pulses forwarded from a detector 8 via a machine-pulse generator so as to allow control circuit 7 to observe the progress of the knitting needles disposed on the outer periphery of the circular knitting machine. Writing pulses generated by a pair of flip-flops are fed to gates $G_1$ and $G_2$ of circuit 2a via gates $G_{21}$ and $G_{22}$ and synchronizing signals forwarded via a gate $G_{24}$ trip a flip-flop circuit $FF_1$ which energizes the counter stages 3a and 3b to synchronize the reading action of the tape reader with the writing action of the counter stage; gating circuits 5a and 5c are caused to perform the switchover between their respective counter stages by shift pulses forwarded from the control circuit via gates $G_{23}$ and $G_{24}$.

The white-yarn signals are generated from the signals for the red and blue yarns. More specifically, signals read by the contacts 4 from both the red and blue counter stages are passed via gates 5a and 5c respectively to NOT circuits 5e which product outputs by logical negation when the signals for both red and blue yarn are 0. The outputs of NOT circuits 5e are fed to selection circuit 6e and then to white-yarn actuators $a_3$, $a_6$, $a_9$ and $a_{12}$.

The required signals are forwarded from selection circuits 6a, 6c and 6e to the 12 actuators $a_1$–$a_{12}$ in accordance with the foregoing table of knit-starting signals, so that the circular knitting machine can produce a knit fabric having a continuous colored pattern by knitting one course of the pattern for each one-quarter rotation thereof.

Selection circuits 6a, 6c and 6e are composed of numerous ordinary gates and these circuits as well as the counter stages and the other circuits shown can be easily constructed with conventional techniques.

Figure 4:
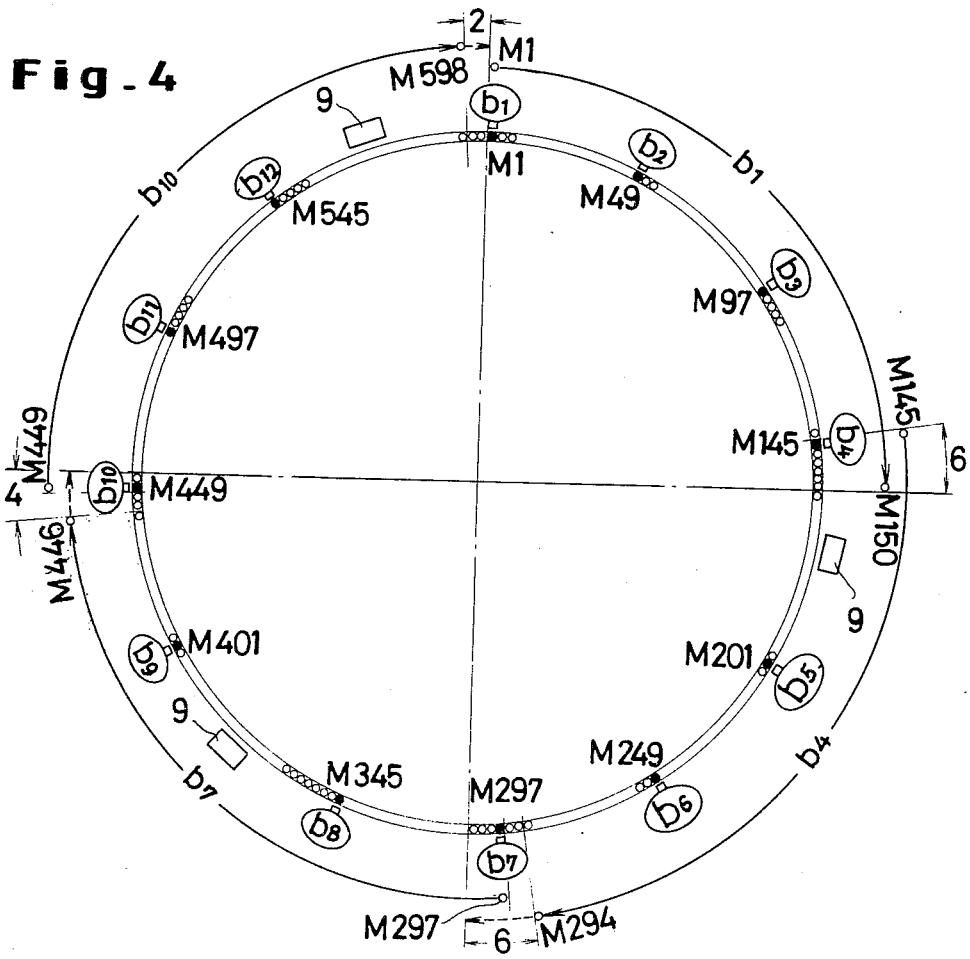
FIG. 4 is a diagrammatic view showing a circular knitting machine wherein the needle actuators are disposed at irregular intervals on the outer peripheral surface thereof.

The above-described example relates to a system in which the actuators are separated by equal intervals of 50 needles around the circular knitting machine. Now, a description will be given of an example readily applicable to the ordinary circular knitting machine which is held in position by three supports 9 as shown in FIG. 4 and as a consequence has its needle actuators disposed at nonuniform distances.

These supports 9 are located in the actuator intervals $b_4$–$b_5$, $b_8$–$b_9$ and $b_{12}$–$b_1$. Consequently, these particular actuator intervals are greater than the other actuator intervals on this circular knitting machine.

When the circular knitting machine makes one quarter rotation to accomplish one "apparent" course of knitting, actuator $b_1$ will have actuated the needles between needle $M_1$ and needle $M_{150}$ and, at the same time, the actuator $b_4$ will have actuated the needles between needle $M_{145}$ and needle $M_{298}$. Consequently, actuators $b_1$ and $b_4$ cause six needles to act twice to knit the pattern on the same pattern course in the interval between needles $M_{145}$ and $M_{150}$.

If the signals to be fed to actuator $b_4$ are delayed by six signals so that actuator $b_4$ rests between needles $M_{145}$ and $M_{150}$ and, instead, performs a knitting operation between needles $M_{295}$ and $M_{300}$, double knitting of the same pattern course is avoided and the pattern knitted by actuator $b_1$ will follow smoothly into the pattern knitted by the actuator $b_4$. It should be kept in mind that, as explained earlier, actuator $b_1$ and actuator $b_4$ are at this time knitting the same course of the pattern but neighboring courses of the fabric itself. Thus, a properly knitted pattern can be attained by delaying the signals fed to actuator $b_4$ by six signals. On the assumption that actuator $b_1$ faces needle $M_1$ at the start of the knitting, actuator $b_4$ will face needle $M_{145}$, actuator $b_7$ will face needle $M_{297}$ and actuator $b_{10}$ will face needle $M_{449}$. If the signals to be fed to actuator $b_4$ are delayed by six signals in order to avoid double knitting of the same pattern course, the signals to be fed to actuators $b_7$ and $b_{10}$ may be delayed by four signals and by two signals respectively and thus the respective delays required to obtain a continuous pattern are a zero-signal delay,a six-signal delay, a four-signal delay and a two-signal delay. In FIG. 4, the solid arcs indicate the range covered by each of the actuators in one-quarter rotation of the knitting machine and the dotted arc extensions show the intervals at which the respective delays are required. The signals are delayed by delay circuits 10 such as those schematically illustrated in FIGS. 5a, 5b, 5c which follow selection circuits 6a, 6b, 6c.

Figure 5A:
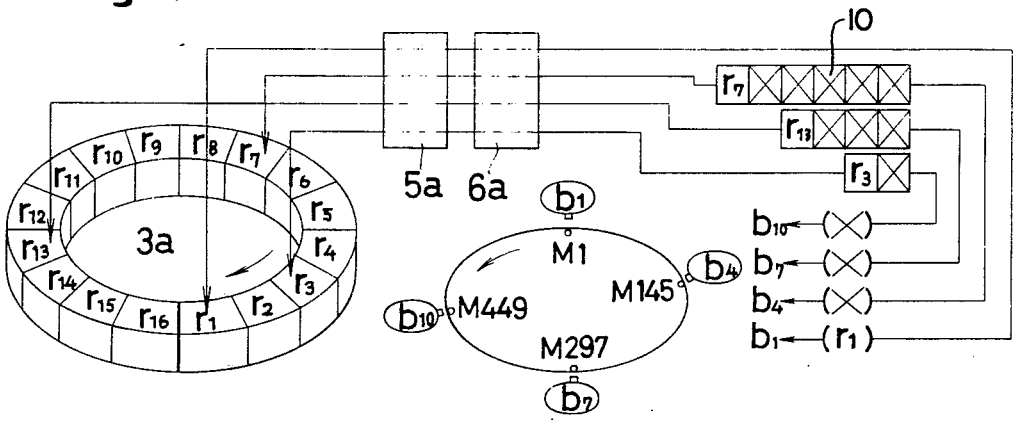
FIGS. 5*a*, 5*b* and 5*c* are diagrammatic views showing different stages of operation of a delay circuit according to this invention.
Figure 5B:
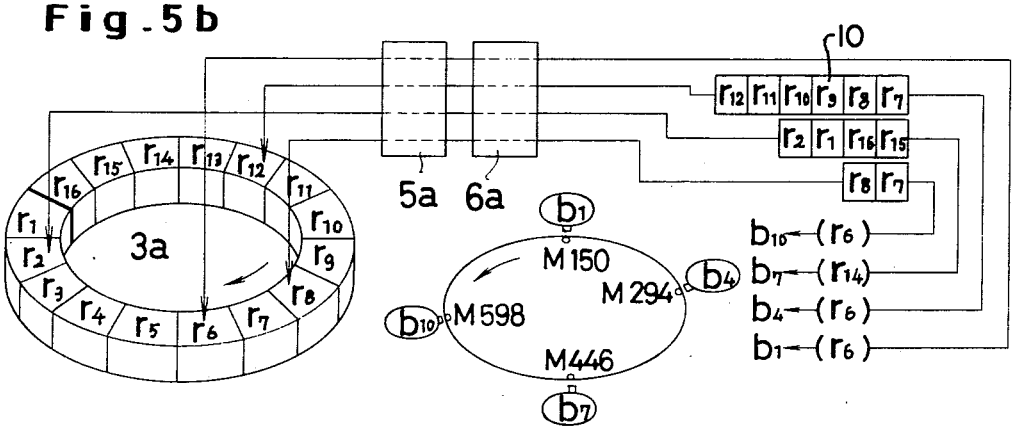
Figure 5C:
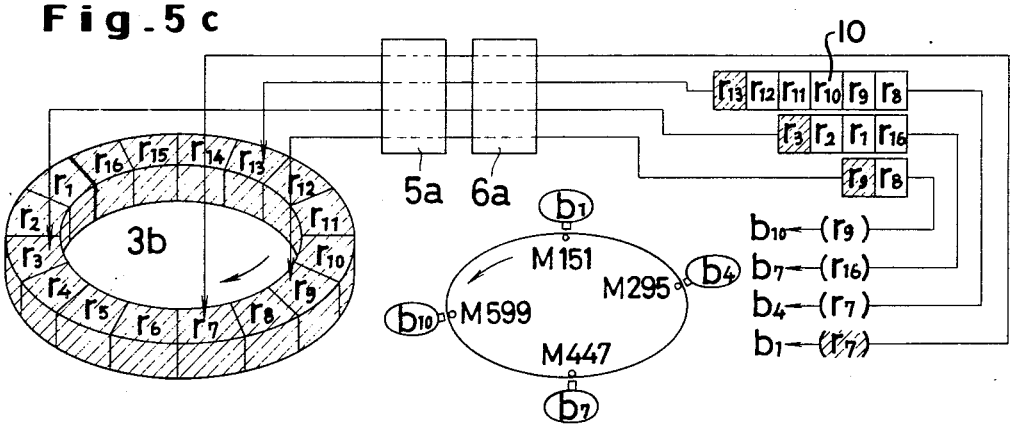

We shall now explain, with reference to FIGS. 5a, 5b, 5c, the knitting operation from the 19th course to the 20th course. In FIG. 5a, the X-marks in the delay circuit 10 indicate signals for knitting the pattern in the 18th course.

When actuator $b_1$ starts to knit the pattern in the 19th course from needle $M_1$, signals $C_1^{19}$ are directly forwarded to actuator $b_1$ without being passed through the delay circuit. The signals fed to actuators $b_4$, $b_7$ and $b_{10}$ are first stored in the delay circuit and then read out one by one (FIG. 5a). Actuators $b_4$, $b_7$ and $b_{10}$ are still receiving 18th-course signals remaining in the delay circuit at the time actuator $b_1$ begins to receive signals for the 19th course. At the time actuator $b_1$ has come to face the second needle $M_2$, actuators $b_4$, $b_7$ and $b_{10}$ are still receiving 18th-course signals, but when the knitting machine advances by one more needle and actuator $b_1$ comes to face needle $M_3$, actuator $b_{10}$ for the first time receives 19th-course signals; namely, specifically signal $r_3$.

The knitting machine continues to rotate until after a one-quarter rotation actuators $b_1$, $b_4$, $b_7$ and $b_{10}$ come to face needles $M_{150}$, $M_{294}$, $M_{446}$ and $M_{598}$, respectively. At this time, the delay circuits for actuators $b_4$, $b_7$ and $b_{10}$ still contain 19th-course signals.

When actuator $b_1$ comes to face the needle $M_{151}$ and, simultaneously, (FIG. 5b), counter stage 3a filled with 19th-course signals is replaced by counter stage 3b filled with 20th-course signals as indicated by hatching, signal $r_7$ of the 20th-course signals is directly fed to actuator $b_1$ and, on the other hand, the other actuators $b_4$, $b_7$ and $b_{10}$ continue to receive 19th-course signals remaining in the delay circuits (FIG. 5c). When the knitting of the pattern for the 20th course is completed, the operation begins again for the 21st course under conditions similar to those shown in FIG. 5a.

In this manner, by using circuits of simple construction for differently delaying the feeding of pattern signals to the needle actuators of each group such as $b_1$, $b_4$, $b_7$ and $b_{10}$, knitting can be easily accomplished on a circular knitting machine wherein the actuators are disposed at irregular intervals around the machine.

It will be noted that the operation of counter stage 3b in FIG. 5c does not completely agree with that described for this counter stage in connection with FIG. 3. Thus, we previously stated that at the time of the switchover between stage 3a and stage 3b, after the completion of one quarter rotation of the circular knitting machine, the fixed contacts in stage 3b are at the positions for the first signals of the ensuing course and that any disparity between the signal read out of counter stage 3b and the signal which should be fed to the actuator is corrected by means of selection circuit 6a. In FIG. 5c, the contacts are shown to point to the corrected or shifted positions from the beginning as if selection circuit 6a were unnecessary. This representation has been made only as an expedient in explaining the system schematically. In fact, at the time of switchover the contacts are at the positions for the first signals and the signal shift is performed by the selection circuit.

Figure 6:
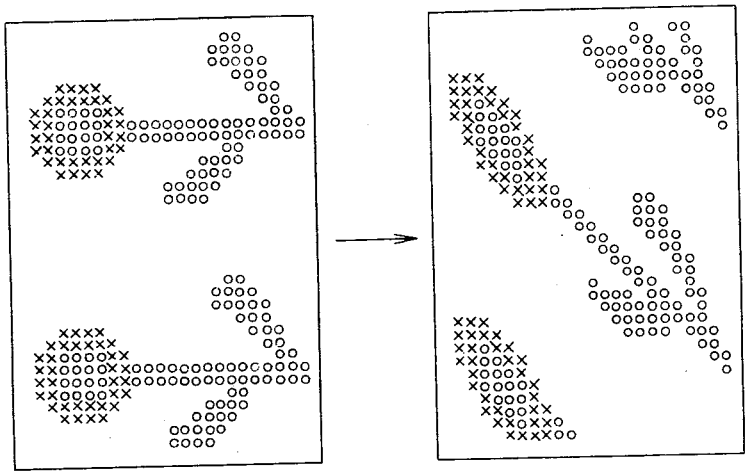
FIG. 6 is a diagrammatic view showing the formation of an oblique pattern by a slanting the original pattern.

We shall now describe a method for causing a pattern to slant in the course of knitting as shown in FIG. 6. As already explained, machine pulses generated by a machine-pulse generator are fed to control circuit 7. Upon detecting from these machine pulses that one quarter rotation of the circular knitting machine has been completed, control circuit 7 issues reset pulses simultaneously to counter stages 3a–3d, gates 5a, 5c, 5e and selecton circuits 6a, 6c, 6e so as to insure that the pattern of the design will be reproduced faithfully on the knitted fabric as shown in the upper view of FIG. 6. If the reset pulses are issued when the actuators face needles other than the needles they ordinarily face after such one-quarter rotation of the circular knitting machine, the knitted pattern will be caused to slant.

Where, for example, "M" is the total number of knitting needles, "m" is the total number of actuators for each yarn color and "$n$" is the number of colors of the pattern (three colors are used in this embodiment), the number of needles active in one course of knitting is defined by $M \times n / m$. If the reset pulses for changing from course No. $j$ to course No. $j+1$ are issued after $(M \times n / m) + 1$ pulses are received by control circuit 7, that is, after receiving all the $j$th-course signals $C_j$ the actuators further receive one more signal (one wale) for the $j$th course, the result will be that the knitted pattern slants as shown in the lower view of FIG. 6.

On the other hand, when the reset action is conducted after each $(M \times n / m) - 1$ pulses, the change of pattern course will occur one signal earlier than usual with the result that the knitted pattern will slant in the direction opposite to that of the pattern shown in the lower view of FIG. 6.

The slant of the pattern can be freely determined by properly selecting the value of $\alpha(= 0, \pm 1, \pm 2 \ldots)$ in the term $(M \times n / m) + \alpha$ and if $\alpha$ is varied as a function $\alpha(C)$ of the knitting course numbers C, an arabesque pattern can be formed. The pattern thus knitted in the fabric can be made to slant by advancing or delaying the time for switching the course signals.

Figure 7:
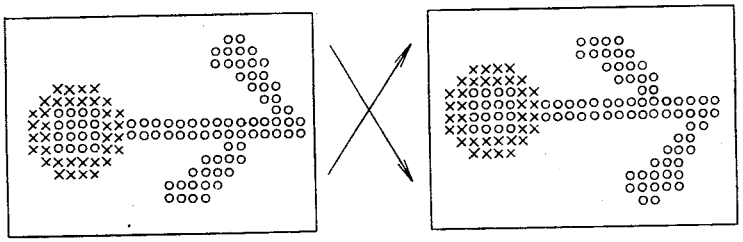
FIGS. 7 and 8 are diagrammatic views each showing the formation of a reverse pattern by inverting the original pattern.

As shown in FIG. 7, the knitted pattern may be modified into its mirror image by reading out the courses of the pattern in the ordinary order but reading out the signals of each course in the reverse sequence. Further, an upside-down pattern as shown in FIG. 8 can easily be produced by reading out the courses in the reverse sequence.

Figure 8:
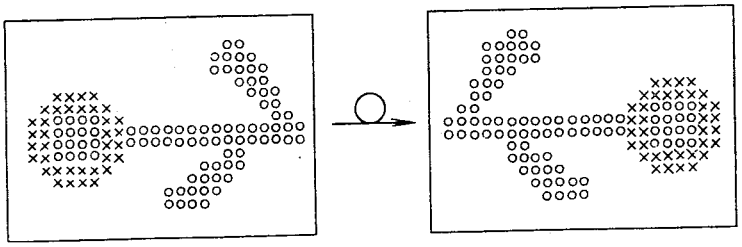

As the modified patterns shown in FIGS. 6–8 can be knitted from the some pattern information as is used for ordinary pattern knitting, they can be selectively introduced into the fabric in a great variety of combinations with the ordinary pattern to produce any number of pattern variations.

We shall next describe a method for eliminating a recurrence of the pattern being knitted from a desired part of the fabric (unfigured knitting ) and, if desired, inserting in the same part another pattern configuration knitted in a direction perpendicular or opposite to the direction of read-out from the tape reader.

In a three-color pattern such as the one discussed above, it is possible to obliterate the pattern in any one of the three colors used. Typically a pattern can be considered to comprise multi-colored figures on a single-colored background and the figures are obliterated in the color of the background although it is, of course, possible to obliterate the pattern in one of the other colors. At any rate, for the sake of this explanation the color chosen to obliterate the pattern will be called the background color.

Pattern-eliminating knitting can be performed over the whole surface of the fabric in either of two ways. The first way involves ignoring the read-out from the tape reader and instead writing the signal 1 (pattern-knitting) in the positions of the counter stages corresponding to actuators for knitting the background color and writing the signal 0 (fabric knitting signal) in the other positions of the counter stages. The second way involves ignoring the read-out of the counter stages as well and applying the signal 1 to the actuators for knitting the background color while applying the signal 0 to the other actuators.

Figure 9:
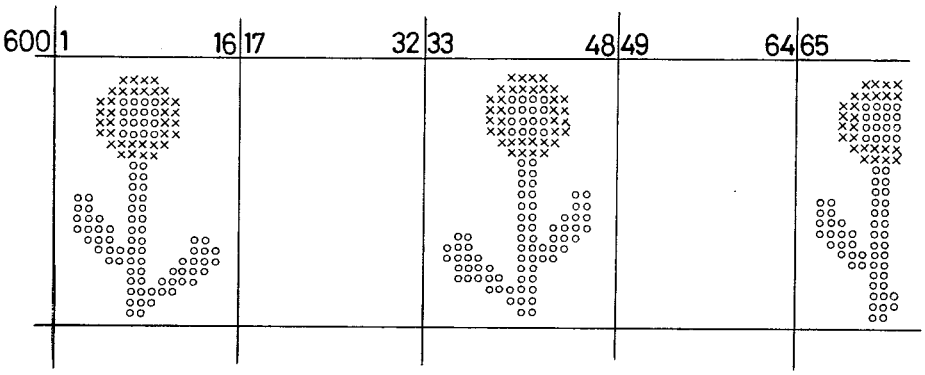
FIG. 9 is a diagrammatic view showing the formation of an intermittent pattern by eliminating every other recurrence of the original pattern.
Figure 10:
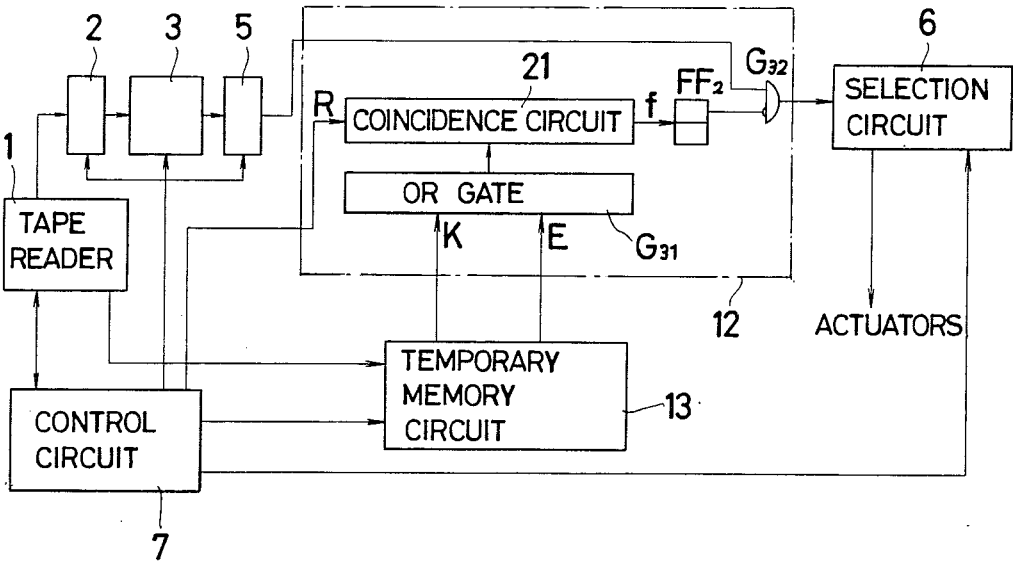
FIG. 10 is block diagram showing a circuit for eliminating a recurrence of the pattern.

However, in order to perform pattern-eliminating knitting only in a desired area, as shown in FIG. 9, it is necessary to provide the device shown in FIG. 3 with an auxiliary circuit 12 and a temporary memory circuit 13. FIG. 10 schematically shows how these circuits fit into the circuitry of FIG. 3, with numerals 2, 3, 5 and 6 collectively representing the units *2a, 2c, 3a–3 d, 5a, 5c, 5e* and *6a, 6c, 6e* of that circuitry.

The information for eliminating a pattern over a given interval of the fabric is first stored in temporary memory circuit 13. For example, in a case such as that shown in FIG. 9 where pattern at elimination is performed every other occurrence information is stored in the temporary memory circuit to the effect that a command K for eliminating the pattern is to be fed to an OR gate $G_{31}$ at the 17th needle and every 32nd needle thereafter (49th needle, 81st needle, 113th needle, . . . ) and that commands E for stopping pattern elimination are to be fed to gate $G_{31}$ at the 32nd needle and every 32nd needle thereafter (64th needle, 96th needle, 128th needle, . . . ). When the actuator (performing knitting in the color of the background comes to face the 17th needle $M_{17}$, the signal for actuating pattern elimination is applied to coincidence circuit 21 via gate $G_{31}$. When the signal coincides with the reading count R forwarded from control circuit 7, an output signal $f$ is generated in a coincidence circuit 21 to set a flip-flop $FF_2$ and to a gate $G_{32}$ via this flip-flop to switch off the information read out of gate 5. Control circuit 7 then applies the signal 1 to the actuator for knitting the background and continues to do so over the interval between the needles $M_{17}$ and $M_{32}$ while the signal 0 is applied to the other actuators throughout this interval. Thus the pattern elimination on the fabric is continued until the actuator comes to face the 32nd needle. After this time, namely, when the actuator comes to the 33rd needle, the signal E is produced by temporary memory circuit 13 and forwarded to coincidence circuit 21 via gate $G_{31}$. When the signal coincides with reading count R from control circuit 7, it is forwarded to flip-flop $FF_2$ to reset same, causing gate $G_{32}$ to open. Consequently, the information read out of gate 5 is again forwarded to selection circuit 6 so that the ordinary knitting of the pattern is performed. Thus the pattern elimination can repeatedly be performed on the fabric by using such circuits whenever the command for eliminating the pattern is given to the circuits.

By this method, a pattern totally different from the pattern currently in use can be formed in a given area by storing in the temporary memory circuit 13 pattern signals corresponding to this different pattern and repeating the method just mentioned.

The above-described methods for pattern slanting, inversion, elimination and substitution may be practiced independently or in any desired combination.

Thus, our improved circular knitting machine can freely perform pattern formation and is simpler in construction than conventional knitting machines. Furthermore, the knitting operation may be quickened by increasing the number of groups of needle actuators, and knitting of a pattern having more than the three colors of the embodiment of this invention described above can be performed by disposing as many groups of needle actuators as there are colors in the pattern and by increasing the number of pairs of counter stages and NOT circuits. In this case, it is desirable that at least two pairs of counter stages and a set of NOT circuits be provided each group of three colors used in the desired pattern.

As the means for controlling the pattern signal is provided apart from the circular knitting machine, centralized control of the knitting operation can easily be performed.

As described in detail with reference to the illustrated embodiments, the method for pattern formation according to the present invention enables knit fabrics of highly advanced patterns to be manufactured with ease. The fact that an electronic data-processing system having a large memory capacity and a high operation speed can be used as a unit for issuing commands on pattern formation proves advantageous from the viewpoint of performance and economy. Another advantage derived from using such a unit for issuing commands to a plurality of knitting machines is the fact that commands on pattern formation can effectively be given even when knitting machines to be controlled have different mechanical specifications as in number of yarn feeders and number of knitting needles or when they use different knitting conditions such as a rate of machine rotation, number of colors in the pattern and pattern width.

What is claimed is:

1. A method of pattern formation in a circular knitting machine provided with a set of selectively operable needle actuators rotatable relatively to an annular array of knitting needles, comprising the steps of:

storing in a memory device pattern signals given in binary notation for a desired pattern to be knitted;

alternatingly writing the pattern signals stored in said memory device into first one and then the other of a pair of counter stages;

reading out the stored pattern signals for one course of pattern knitting from one counter stage of said pair simultaneously with the writing of the stored pattern signals for the next course of pattern knitting in the other counter stage of said pair;

feeding the pattern signals read out from said one counter stage of said pair to corresponding needle actuators; and switching over to the other counter stage of said pair for feeding the pattern signals read out therefrom to corresponding needle actuators after completion of one course of pattern knitting.

2. A method of pattern formation in a circular knitting machine provided with a set of selectively operable needle actuators rotatable relatively to an annular array of knitting needles, comprising the steps of:

storing in a memory device pattern signals given in binary notation for several colors of a desired multicolor pattern including an additional color besides said several colors, each color of said pattern being assigned to a corresponding group of needle actuators;

alternatingly writing the pattern signals for each color stored in said memory device into first one and then the other of a corresponding pair of counter stages;

reading out the stored pattern signals for one course of pattern knitting from one counter stage of each pair simultaneously with the writing of the stored pattern signals for the next course of pattern knitting in the other counter stages of each pair;

feeding the stored pattern signals for each of said several colors, read out from said pairs of counter stages, to a corresponding group of needle actuators and simultaneously feeding further pattern signals for said additional color, obtained from said stored pattern signals by logical negation, to the remaining group of needle actuators; and switching over between the counter stages of each pair after each relative rotation of said needle actuators of said knitting needles by a number of needles obtained by dividing the total number of needles by the number of groups of needle actuators.

3. A method of pattern formation in a circular knitting machine provided with a set of selectively operable needle actuators rotatable relatively to an annular array of knitting needles, comprising the steps of:

storing in a memory device pattern signals given in binary notation for several colors of a desired multicolor pattern including an additional color besides said several colors, each color of said pattern being assigned to a corresponding group of needle actuators;

alternatingly writing the pattern signals for each color stored in said memory device into first one and then the other of a corresponding pair of counter stages;

reading out the stored pattern signals for one course of pattern knitting from one counter stage of each pair simultaneously with the writing of the stored pattern signals for the next course of pattern knitting in the other counter stage of each pair;

obtaining further pattern signals for said additional color from said stored pattern signals by logical negation;

electrically selecting among said stored and further pattern signals the pattern signals to be fed to each group of needle actuators upon a switchover between the counter stages of each pair after completion of each course of pattern knitting; and forwarding the selected pattern signals to the corresponding needle actuators.

4. A method of pattern formation in a circular knitting machine provided with a set of selectively operable needle actuators rotatable relatively to an annular array of knitting needles, comprising the steps of:

storing in a memory device pattern signals given in binary notation for several colors of a desired multicolor pattern including an additional color besides said several colors, each color of said pattern being assigned to a corresponding group of needle actuators;

alternatingly writing the pattern signals for each color stored in said memory device into first one and then the other of a corresponding pair of counter stages;

reading out the stored pattern signals for one course of pattern knitting from one counter stage of each pair simultaneously with the writing of the stored pattern signals for the next course of pattern knitting in the other counter stage of each pair;

obtaining further pattern signals for said additional color from said stored pattern signals by logical negation;

electrically selecting among said stored and further pattern signals the pattern signals to be fed to each group of needle actuators upon a switchover between the counter stages of each pair completion of each course of pattern knitting;

differently delaying the automatically selected pattern signals fed to each group of needle actuators; and feeding the differently delayed pattern signals to the corresponding needle actuators.

5. A method of pattern formation according to claim 3, further comprising the step of ignoring the stored pattern signals read out of said memory device and instead writing pattern signals in said counter stages corresponding to needle actuators for knitting a desired background color and preventing pattern signals from being written in the other counter stages, thereby causing the knitted pattern to be eliminated at a desired area of the fabric.

6. A method of pattern formation according to claim 3, further comprising the step of ignoring the electrically selected pattern signals and instead feeding pattern signals directly to said needle actuators for knitting a desired background color and preventing pattern signals from being fed to the ther needle actuators, thereby causing the knitted pattern to be eliminated at a desired area of the fabric.

7. A method of pattern formation according to claim 3, further comprising the step of varying the number of pattern signals required for one course of pattern knitting, thereby causing the knitted pattern to slant.

8. A device for pattern formation in a circular knitting machine provided with a set of selectively operable needle actuators rotatable relatively to an annular array of knitting needles, comprising in combination:

a memory device for storing pattern signals given in binary notation for a desired pattern to be knitted:

at least two pairs of counter stages receiving said pattern signals read out of said memory device, the counter stages of each of said pairs being operatively connected so that one of said counter stages performs a reading-out operation of said pattern signals of one course while the other stage performs a writing operation of said pattern signals of the next course, with switchover between the counter stages of each of said pairs upon completion of one course of pattern knitting;

a plurality of selection circuits for selecting the proper pattern signals to be forwarded to each of a plurality of groups of said needle actuators after each switchover of said pairs of counter stages; and a control circuit which receives machine pulses generated synchronously with the relative rotation of the set of needle actuators and the array of knitting needles and on the basis thereof issues synchronizing signals to said memory device, said pairs of counter stages and said selection circuit to control the operation thereof.

9. A device for pattern formation in a circular knitting machine provided with a set of selectively operable needle actuators rotatable relatively to an annular array of knitting needles, comprising in combination:

a memory device for storing pattern signals given in binary notation for several colors of a desired multicolor pattern including an additional color besides said several colors, each color of said pattern being assigned to a corresponding group of needle actuators;

at least two pairs of counter stages receiving the stored pattern signals for said several colors read out of said memory device, the counter stages of each of said pairs being operatively connected so that one of said counter stages performs a reading-out operation of the pattern signals of one course while the other pattern signals of the next course, with switchover between the counter stages of each of said pairs upon completion of one course of pattern knitting;

at least one NOT circuit for producing further pattern signals for said additional color from said stored pattern signals;

a plurality of selection circuits for selecting from among said stored and further pattern signals the proper pattern signals to be forwarded to each of needle actuators after each switchover of said pairs of counter stages; and a control circuit which receives machine pulses generated synchronously with the relative rotation of the set of needle actuators and the array of knitting needles and on the basis thereof issues synchronizing signals to said memory device, said pairs of counter stages, said NOT circuit and said selection circuits to control the operation thereof.

10. A device for pattern formation in a circular knitting machine provided with a set of selectively operable needle actuators rotatable relatively to an annular array of knitting needles, comprising in combination:

a memory device for storing pattern signals given in binary notation for several colors of a desired multicolor pattern including an additional color besides said several colors;

at least two pairs of counter stages receiving the stored pattern signals for said several colors read out of said memory device, the counter stages of each of said pairs being operatively connected so that one of said counter stages performs a reading-out operation of the pattern signals of one course while the other counter stage performs a writing operation of said pattern signals of the next course, with switchover between the counter stages of each of said pairs upon completion of one course of pattern knitting;

at least one NOT circuit for producing further pattern signals for said additional color from said stored pattern signals;

a plurality of selection circuits for selecting from among said stored and further pattern signals the proper pattern signals to be forwarded to each group of needle actuators after each switchover of said pairs of counter stages;

a plurality of delay circuits for differently delaying the pattern signals forwarded from said selection circuits to the needle actuators of each group; and a control circuit which receives machine pulses generated synchronously with the relative rotation of the set of needle actuators and the array of knitting needles and on the basis thereof issues synchronizing signals to said memory device, said pairs of counter stages, said NOT circuit and said selection circuits to control the operation thereof.

11. A device for pattern formation according to claim 9, further comprising:

a temporary memory circuit for storing commands for pattern elimination; and a coincidence circuit responsive to a concurrence of said commands, issuing from said temporary memory circuit, with counting signals read out of said control circuit for performing pattern elimination.

* * * * *